United States Patent [19]

Barnabo et al.

[11] 4,211,104

[45] Jul. 8, 1980

[54] COLD DRAWING DIE FOR DRAWING POLYGONAL SHAPES

[75] Inventors: Robert E. Barnabo, Bloomfield Hills; Karl J. Hyslop, Westland, both of Mich.

[73] Assignee: Barnabo Steel Corporation, Canton, Mich.

[21] Appl. No.: 20,376

[22] Filed: Mar. 14, 1979

Related U.S. Application Data

[63] Continuation of Ser. No. 866,129, Dec. 30, 1977, abandoned.

[51] Int. Cl.[2] ..... B21C 3/04

[52] U.S. Cl. ..... 72/467

[58] Field of Search ..... 72/467, 377

[56] References Cited

U.S. PATENT DOCUMENTS 3,973,428 8/1976 Lugosi ..... 72/467

FOREIGN PATENT DOCUMENTS 651091 3/1951 United Kingdom ..... 72/467

*Primary Examiner*—Milton S. Mehr

*Attorney, Agent, or Firm*—Krass & Young

[57] ABSTRACT

A cold drawing die for drawing round bar stock into shapes such as polygons. The die acts continuously on the full circumference of the round bar stock to uniformly deform the stock and yield polygons to exacting specifications using a starting material only slightly larger than the maximum diameter of the finished shape. A pure polygon and a hybrid polygon shape are disclosed.

7 Claims, 7 Drawing Figures

COLD DRAWING DIE FOR DRAWING POLYGONAL SHAPES

This is a continuation of application Ser. No. 866,129 filed Dec. 30, 1977, now abandoned.

INTRODUCTION

This invention relates to cold drawing and particularly to a cold drawing die for producing polygonal shapes from round stock.

BACKGROUND OF THE INVENTION

Cold drawing of polygonal shapes yields a finished shape with harder surfaces, a higher yield strength, and conformed to closer tolerances than hot formed stocks. These finished shapes are suitable for machining into hex nuts and other small parts. Heretofore, in cold drawing of polygonal shapes such as hexagons, a shape or hexagon larger than the finished polygon is used as the starting material. This leads to several problems.

Typically, manufacturers of cold drawn stocks produce a number of different shapes and sizes. Without this invention they must carry an inventory of raw material bar stock of the same shapes and sizes as their finished products. This requires a much larger inventory overhead expense than is the case if it were only necessary to keep an inventory of different sizes of round stock.

Another problem commonly encountered is the result of a twisting defect in the starting material. The starting material is a coil of a hot rolled form. In the coiling process a twist is often imparted to the stock. During the cold drawing of this type of stock material, the die through which the bar stock is being drawn acts as a straightener. The twists are compressed into the area just ahead of the die. At some point the stored twisting force becomes greater than the compressive resistance of the stock as it passes through the die. The stock then flips over. That is, one corner of the polygon or hexagon shape moves laterally across an adjacent straight side and settles into an adjacent corner. Because the bar stock is continually moving through the die, the corners are distorted as they move across the straight sides.

The whole section of stock that passes through the die as the corners are flipping must then be scrapped. This flipping over also frequently results in the fracturing of the die. Of course, this does not happen if round stock is used as the starting material because it is circumferentially symmetrical.

In the prior art when trying to draw a polygonal shape from a round bar, edge defects are often encountered. Looking at a cross-section of the stock perpendicular to its long axis as it encounters a polygonally shaped die, we see that the initial contact point is on the periphery of the cross-section of the stock and the middle of a flat side of the die. The die acts on this edge of the cross-section and pushes it back in relation to the central axis of the stock. Since this is the area of greatest deformation or deepest draft, the force is considerable. The adjacent areas of the perpendicular cross-section not contacted by the die are also pulled back. This leaves a void or lack of material at the apex of the angle between the two straight sides. If the round stock is only slightly larger than the maximum cross corner radius of the finished polygon, there will be gaps where material does not fill the corners and the piece will be defective. If the diameter of the round stock is sufficiently large to prevent this defect, the force required to draw this stock through the die is prohibitive. The larger the original bar stock the greater are the stresses of deformation. The greater the stress, the more force required to accomplish the deformation. This extra force will also act to squeeze out lubricant from between the die and the bar stock and increase frictional resistance.

BRIEF SUMMARY OF THE INVENTION

The present invention provides an improved cold drawing die for making polygonal shaped bars from round stock, wherein edge defects are eliminated and sharply defined shapes may be produced with a drawing force substantially equivalent to that of the prior art.

In general this is accomplished by providing a die having a polygonal bearing zone with at least one straight side, and an entry zone characterized by a full round initial opening or contact zone and shaping planes tangential to the round initial opening which gradually lead into the straight sides such that continuous full circumferential contact is maintained between the die and the stock throughout the draw.

In a specific embodiment hereinafter described, the entry zone has a circular cross-section at its forward end. It contains semi-elliptical shaping planes equal in number to the straight sides of the finished shape, and shaping corners which lead gradually into the apex of the bearing corners. The shaping planes angle inwardly from the initial circular contact zone to meet the sides of the bearing zone. The preferred shaping plane of this invention will be angled at successively smaller angles to the axis of the die as it approaches the bearing zone but this invention also covers a flat shaping plane with a fixed angle to the die axis.

As used herein the term "polygon" refers to any multisurface section, including those with one or more non-flat portions.

The angles and dimensions in FIGS. 3 through 7 are exaggerated to better show the detail of the invention.

DESCRIPTION OF THE PREFERRED EMBODIMENTS

Figure 1:
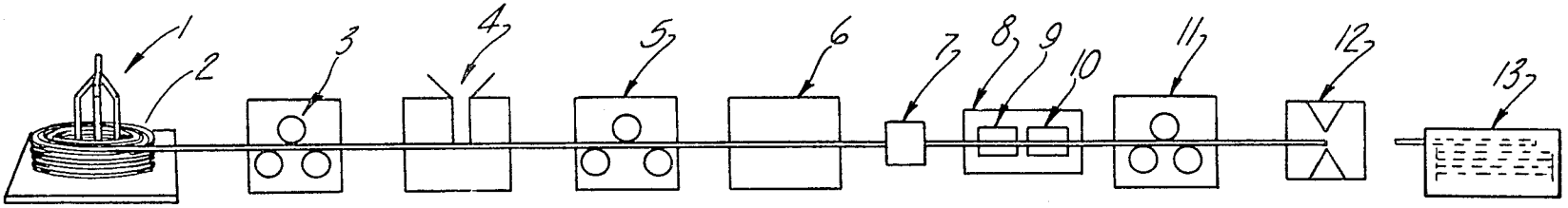
FIG. 1 is a block diagram of a cold drawing line.

FIG. 1 is a block diagram of a cold drawing line in which round stock 2 is drawn through a shaping die and cut into desired lengths. The bar stock 2 is received in coils which are placed on a decoiler 1 which rotates in the same direction the stock is coiled thus providing the force to uncoil the stock.

The stock then travels through a straightener 3 and into a Wheelabrator shot descaler 4. The shot descaler takes the rust and scale off the surface of the stock by forcible impingement of small steel shot. The clean stock then goes through another straightener 5.

After this the stock passes through a push pointer 6 which operates intermittently. The push pointer is only activated to start the stock through the die with a pushing action. Once the pullers take over as hereinafter described, the pusher disengages and lies idle.

The bar stock then encounters the die held in the die holder 7. The die is lubricated continuously and deforms the bar stock to the desired shape.

Next, the puller 8 grips the stock and pulls it through the die. There are two grippers 9 and 10 in the illustrated line. They grip and pull alternately to give the stock a continuous linear velocity.

After passing through the puller the stock is straightened once more in a straightener 11. The stock is then cut into the desired lengths by a cutter 12 and stacked by a stacker 13. The combined drawing apparatus used for drawing in these embodiments is a commercially available product, for example a Schumag Combined Drawing Machine Model No. KZ-II-B.

The die body 66 is tapered and sets into the tapered hole 71 in the die stand 7. The holder plate 67 holds the die in place, and in turn is held in place by the setscrews 68. The circumferential ridge 70 acts as a relief and facilitates removal of the die from the holder.

The stock to be deformed enters the assembly through an orifice 72 in the holder plate 67. It then passes through the passage of the die and is deformed to the desired shape.

Figure 3:
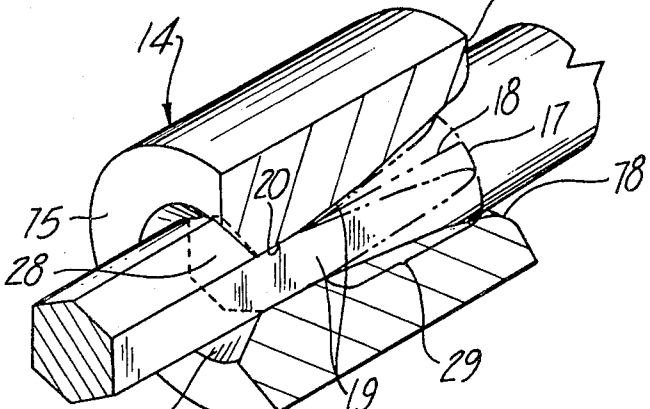
FIG. 3 is a cut-away of the die for drawing a hexagonal bar from round stock.
Figure 2:
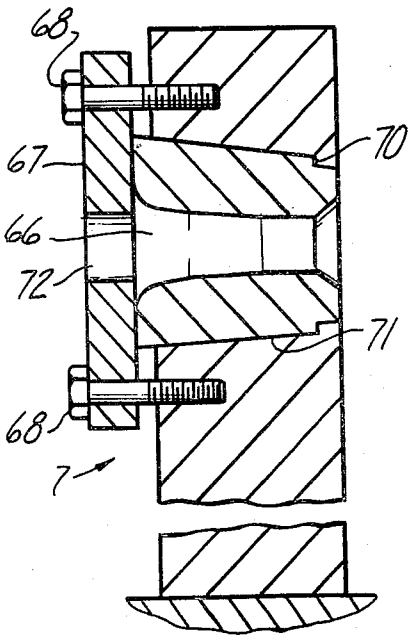
FIG. 2 is a view of a die in its holder.

FIG. 3 shows a cut-away view of the die for forming a hexagon comprising a body 14 of high hardness material having an axial passage 28 formed between opposite plane faces 75 and 76. The axial passage 28 is divided into three zones: an entry zone 29, the bearing zone 20, and a reverse angled relief zone 15.

The entry zone 29 has a circular cross-section at its forward edge 78. The initial contact point 17 is also circular in cross-section. The internal surface of the entry zone 29 contains the shaping planes 19 and the shaping corners 18. The shaping planes 19 take the form of a semi-ellipse with their forward ends rounded and tangent to the circular cross-section of the initial contact, point 17. The area on which the shaping plane exerts its force on the stock starts out as a small point and gradually increases in width until the shaping plane 19 meets the bearing zone 20. Concurrently, the shaping corner 18 gradually deforms the round bar section into a sharp angle. As the round sections on either side of the apex of the corner become straighter, the area contacted becomes less because of the widening shaping planes. Hence, full circumferential contact between the stock and the die exists along the entire axial length of the die; i.e., there are no corner gaps. This gradual shaping allows the use of stock only slightly larger than the maximum cross corner diameter of the finished shape.

The next part of the die encountered by the deforming stock is the bearing zone 20 which gives the stock its final shape to exacting tolerances. The reverse angled exit zone 15 allows for expansion of the stock as it exits the die.

Figure 4:
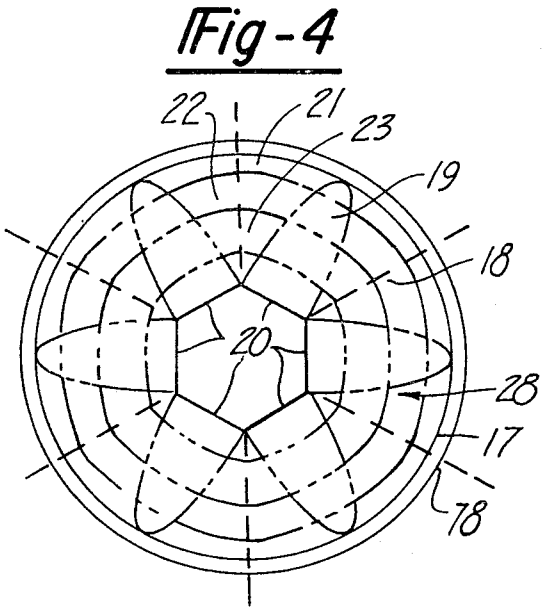
FIG. 4 is an end view of the die of FIG. 3 from the entry side of the die.

FIG. 4 shows an end view of the internal surface of the die of FIG. 3 from the side on which the bar stock would enter the die. The axial passage 28 has an initial circular cross-section 78. As the bar stock moves into the die opening 28 it encounters the initial contact point 17 around its full circumference. The bar stock will then encounter shaping planes 19 and shaping corners 18.

The shaping plane 19 has the outline of a semi-ellipse. Its forward edge is tangent to the initial contact point 17 and angles inwardly until it meets the straight side of the bearing 20. This way the straight sides of the final shape are formed gradually rather than all at once. In between the shaping planes 19 are the shaping corners 18.

Figure 5:
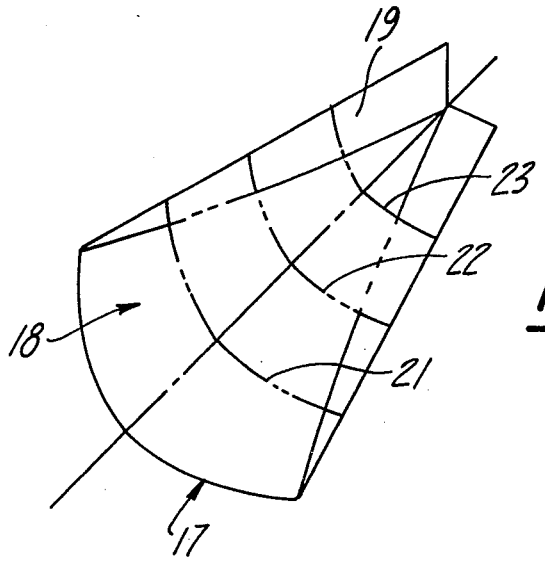
FIG. 5 is a detailed view of a shaping corner.

FIG. 5 gives the detail of a shaping corner. The lines 21, 22 and 23 do not exist on the die but are in the figure to show the changing shape of the cross-section of the die. The cross-section at the initial contact point 17 is round. In sections of the shaping corner closer to the bearing, the angle of the corner becomes more pronounced and the cross-sections become straighter on either side of the apex of that angle. As the shaping planes become wider, the sections of the shaping corner also become smaller until, at a point immediately in front of the bearing, the edges of the shaping planes meet and the shaping corner degenerates into the apex of a sharp angle.

Figure 6:
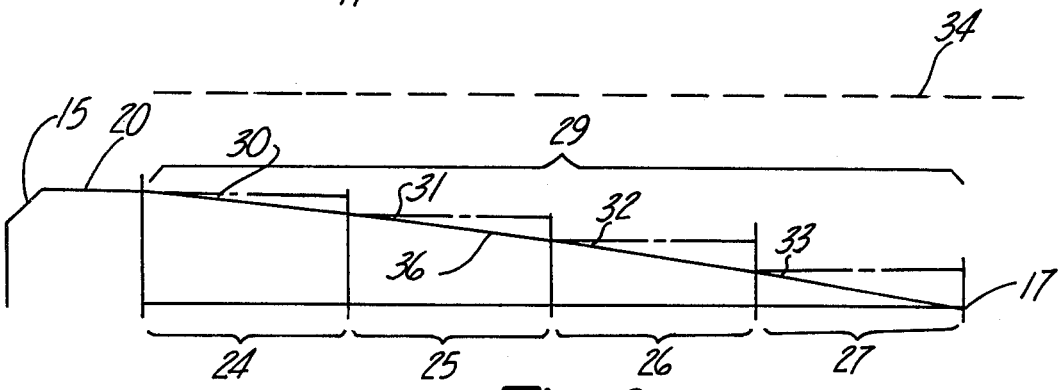
FIG. 6 is a detailed view of the cross-section of an angled shaping plane taken along the intersection of the shaping plane and the plane running through the axis of the die and normal to the transverse surface of the shaping plane.

FIG. 6 shows the cross-section of an angled shaping plane. The shaping plane may be flat but the better form for it to take is that of decreasingly smaller angles as the shaping plane approaches the bearing zone. The angling is generally done in four zones. The stock initially contacts the die at initial contact point 17 and gradually passes through the entry zone 29 until it contacts the bearing 20 and the relief zone 15. Again angles and distances are greatly exaggerated to more clearly show the detail.

In zone 27 of the die the angle 33 that the shaping plane takes to a line parallel to the axis 34 is greater than the angle 32 in zone 26. The angles 31 and 30, being closer of the bearing are increasingly smaller. The actual die will not have four distinct flat zones but will show a smooth curve through all four zones as shown by the line 36.

Figure 7:
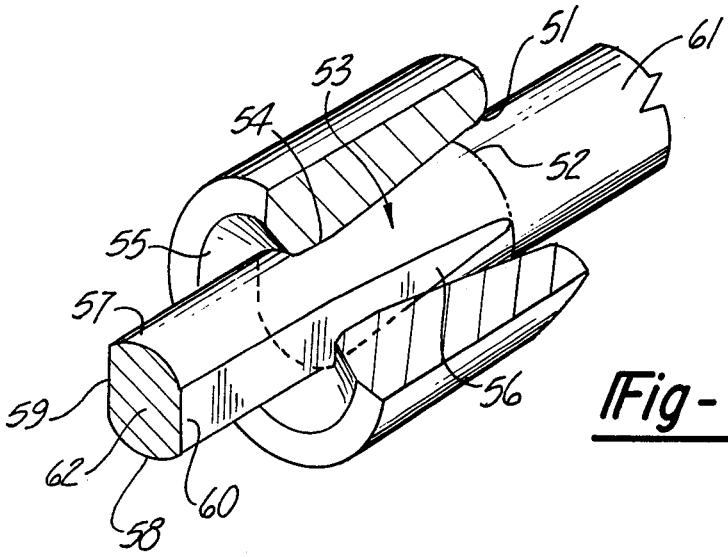
FIG. 7 is a cut-away view of the die for drawing a double D bar from round stock.

FIG. 7 is a cut-away view of the die for drawing a double D bar from round stock. With this die round stock 61 is drawn to the finished shape 62. The double D bar has two round sides 57 and 58 which take the form of two diametrically opposed arcs of the same circle. The curved sides will be equal in length. Two sides 59 and 60 are parallel to each other, equal in length and diametrically opposed.

As with the die of FIG. 3 this die has an entry zone 53, a bearing zone 54 and reverse angle relief zone 55. The bar stock 61 enters the die at the initial circular cross-section 51 and contacts the die at the initial contact point 52. One of the two shaping planes of this die is shown at 56. It starts from a point near the forward edge of the die at the initial contact zone 52, angles inwardly from the initial circular cross-section 51 until it meets the straight side of the bearing zone 54. This shaping plane 56 may be either straight or angled.

EXAMPLE I

This example relates to a die which will deform 0.891 inch round bar stock into a hexagon 0.750 inches across the straight sides. A similar die is shown in FIG. 3. The die is an annular piece of high hardness material, generally steel with a heat-fitted tungsten carbide insert. Those generally skilled in the art will know other materials which can be substituted.

The diameter of the circular cross-section of the initial contact zone will be 0.891 inches. The entry zone will have a length of 0.546 inches measured along the axis of the die. The initial zone 27 of the shaping plane will take an angle of 9° with a line parallel with the axis of the die. It will be ¼ of the length of the total shaping plane or 0.1365 inches.

The second zone 26 will take an angle of 8° with a line parallel to the axis of the die and have a like length. The third zone 25 and fourth zone 24 will be 7° and 6° respectively from the axis of the die and have like lengths with the first and second zones. The angles of the shaping plane will be blended together so as to form a smooth curve.

There will be 6 angled shaping planes and 6 shaping corners in this die. The shaping corner will be 0.546 inches in length along the axis of the die. It will take a shape as described earlier in this specification.

The stock then encounters the bearing zone 20 which is 0.470 inches long in the axial direction. The bearing will have a diameter across the straight sides of 0.747 inches to allow for expansion of the stock as it leaves the die. Immediately behind the bearing zone is the reverse angled relief zone where the internal surface of the die angles sharply away from the axis of the die. This permits expansion of the stock as it moves out of the bearing zone.

Since the diameter of the original bar stock is 0.891 inches and the distance across the straight sides of the finished shape is 0.750 inches the draft in this area is 0.0705 inches. That is, ½ the decrease in the diameter. The draft on the shaping corner will be 0.0155 inches. When the bar is drawn through this die it will yield a hard cold drawn hexagonal shape 0.75 inches across the straight sides with a tolerance of −0.003 inches.

Drawing a hexagonal shape from round stock of this size without edge defects and with only a 0.0155 inch draft on the corners has not been done until the die of this invention. The drawing force required in this example is only slightly more than that required to draw hot formed hexagonal bar stock through a hexagonal die with recommended draft. If one draw round bar stock of a size large enough to avoid edge defects through a hexagonal shaped die, of the prior art, the drawing force required would be 1½ to 2 times as great as the drawing force in this example.

EXAMPLE 2

This example relates to a die for forming a double D bar. A cut-away view of the die is shown in FIG. 7. This will also illustrate the action of the shaping planes without shaping corners. A double D bar is a bar with a round cross-section except for two diametrically opposed, equal, parallel straight sides.

The bar stock has an original diameter of 0.969 inches. The initial contact zone 52 has a diameter of 0.969 inches also. The two diametrically opposed shaping planes are of the angled variety.

The zone of the angled shaping planes nearest the initial contact zone 52 will taken an angle 33 of 12° with the axis of the die 34. The second 26, third 25, and fourth 24 take angles of 10°, 8° and 6° respectively. Again the shaping planes do not show distinct zones but the angles blend into a smooth curve 36.

The length of the entry zone 53 is 0.671 inches. The length of the bearing zone 54 of 0.500 inches. The diameter across the straight sides 59 and 60 of the finished bar is 0.756 inches. The diameter across the round sections 57 and 58 is 0.938 inches.

The practice of this example allows the drawing of a double D shaped bar with substantially less force than the prior art die.

It will be understood that the invention has been described with reference to specific illustrative embodiments and that the foregoing description is not to be construed in a limiting sense.

We claim:

1. A cold drawing die for deforming a solid round bar into a desired polygonal shape wherein a drawing force is applied by pulling the bar through the die and wherein the improvement comprising: a body of high hardness material having opposite faces and adapted to be fixed in a die holder, an axial passage formed in said body between said faces and having an entry zone, and exit zone and a polygonal bearing zone mediate said entry and exit zones; said entry zone being characterized by an initially circular cross-section of such size as to make full circumferential contact with the bar, said entry zone further having at least one semi-elliptical shaping plane, the number of said shaping planes being equal to the number of straight sides in the desired shape, said shaping planes being tangent on one end to said initial circular cross-section and increasingly gradually in width, but angled inwardly from said circular cross-section toward said bearing zone; each said angled shaping plane being configured to provide a gradually decreasing angle of contact with a bar being deformed thereby and taken relative to the axis of said passage, the angularity of said shaping plane lying in the range of about 0° to 12° throughout the effective length thereof; said bearing zone having straight sides contiguous to the ends of said semielliptical shaping planes; said exit zone being angled radially outward from said bearing zone, whereby continuous full circumferential contact is maintained between the die and the stock throughout the drawing process.

2. A cold drawing die as defined in claim 1 wherein the semi-elliptical shaping planes are angled inwardly from said circular cross-section at successively smaller angles to a line parallel to the axis of said axial passage as the shaping planes extend toward the bearing zone.

3. A cold drawing die as defined in claim 2 including:

a bearing zone having four sides consisting of two equal concentric equiradial diametrically opposed arcs and two mediate diametrically opposed equal parallel straight sides;

an entry zone having two angled semi-elliptical shaping planes diametrically opposed to each other, said shaping planes having four zones equal in length along the axis of the axial passage, said zone closest to initial circular cross-section having an angle of about 12° with the axis, the next closest zone having an angle of about 10° with the axis, the next closest zone having an angle of about 8° with the axis and the zone contiguous with the straight side of the bearing zone having an angle of about 6° with the axis, said zones blending with each other to form a smooth curve.

4. A cold drawing die as defined in claim 1 including:

an entry zone further having a plurality of shaping corners mediate said shaping planes and extending from said initial round section to said bearing zone;

said bearing zone having straight sides contiguous to the end of said semi-elliptical shaping planes and corners contiguous to the rearward end of said shaping corners.

5. A cold drawing die as defined in claim 4 including:

a bearing zone having 6 straight sides equal in length and six sharp equiangular corners mediate said sides forming a regular hexagon;

an entry zone having 6 shaping corners contiguous at their narrow ends to the corners of the bearing zone, and 6 angled semi-elliptical shaping planes contiguous on their flat sides to the straight sides of the bearing zone;

said angled semi-elliptical shaping planes having four zones equal in length along the axis of the axial passage;

6. A cold drawing die as defined in claim 5 including further:

in the said bearing zone, a distance between opposite straight sides of 0.748 inches, and an axial length of 0.470 inches:

in the entry zone a diameter of 0.891 inches at the initial circular cross-section, and the length of 0.546 inches measured along the axis of said axial passage;

said four zones of the shaping planes having the following angles: said zone closest to the initial circular cross-section having an angle of approximately 9° with the axis of the axial passage, the next closest zone having an angle of 8° with said axis, the third closest zone having an angle of 7° with said axis and the zone contiguous with the straight side of the bearing zone having an angle of 6° from said axis, said zones blending with each other to form a smooth curve.

7. A cold drawing die for deforming a solid round bar into a desired polygonal shape wherein the drawing force is applied by pulling the bar through the die comprising:

a body of high hardness material having opposite faces and adapted to be fixed in a die holder, an axial passage formed in said body between said faces and having an entry zone, an exit zone and a polygonal bearing zone mediate said entry and exit zones; said entry zone being characterized by an initially circular cross-section of such size as to make full circumferential contact with the bar, said entry zone further having at least two semi-elliptical shaping planes, the number of said shaping planes being equal to the number of straight sides in the desired shape, said shaping planes being tangent on one end to said initial circular cross-section and increasing gradually in width, but angled inwardly from said circular cross-section toward said bearing zone and configured into steps of smoothly integrated nature so as to exhibit gradually decreasing angles of contact measured relative to the axis of said passage, all of said angles being in the range between about 0° and 12°; said entry zone further having a plurality of shaping corners, each of which lies mediate two adjacent shaping planes and extending from said initial circular cross-section to said bearing zone; said bearing zone having straight sides contiguous to the rearward end of said semi-elliptical shaping planes and corners contiguous to the rear end of said shaping corners and an angle of contact with said solid round bar of substantially 0° relative to the axis of said passage; said exit zones being angled radially outward from said bearing zone, whereby continuous full circumferential contact is maintained between the die and the stock throughout the drawing process.

* * * * *